US008020497B2

(12) United States Patent
Ossorguine

(10) Patent No.: US 8,020,497 B2
(45) Date of Patent: Sep. 20, 2011

(54) TWO-TIERED, INTERLOCKING, KNOCKDOWN FURNITURE

(76) Inventor: Andrew Ossorguine, Glen Cove, NY (US)

( * ) Notice: Subject to any disclaimer, the term of this patent is extended or adjusted under 35 U.S.C. 154(b) by 242 days.

(21) Appl. No.: 12/352,609

(22) Filed: Jan. 13, 2009

(65) Prior Publication Data

US 2010/0175599 A1 Jul. 15, 2010

(51) Int. Cl.
*A47B 13/00* (2006.01)

(52) U.S. Cl. ..... 108/157.14; 108/165; 108/180

(58) Field of Classification Search ..... 108/153.1, 108/157.14, 157.1, 157.15, 157.16, 157.17, 108/157.18, 159, 158.12, 91, 90, 180, 182, 108/183, 165; 312/257.1, 259
See application file for complete search history.

(56) References Cited

U.S. PATENT DOCUMENTS

| | | | | | |
|---|---|---|---|---|---|
| 565,435 | A * | 8/1896 | Crater | 108/157.1 |
| 795,957 | A * | 8/1905 | Cartland | 108/157.16 |
| 1,047,882 | A | 12/1912 | Beach | |
| 1,251,661 | A * | 1/1918 | Hendershott | 108/157.16 |
| 1,793,709 | A * | 2/1931 | Meyers | 108/157.16 |
| 1,879,087 | A * | 9/1932 | Chomik | 108/157.16 |
| 1,903,631 | A * | 4/1933 | Morrison | 108/150 |
| 1,940,117 | A | 12/1933 | Carpos | |
| 2,000,915 | A | 5/1935 | Blake | |
| 2,235,290 | A | 3/1941 | Exline | |
| 3,338,189 | A | 8/1967 | Xavier | |
| 3,566,808 | A * | 3/1971 | Slate et al. | 108/157.14 |
| 3,572,824 | A * | 3/1971 | Schupbach et al. | 297/158.5 |
| 3,705,556 | A | 12/1972 | Kelly | |
| 3,724,399 | A * | 4/1973 | Notko et al. | 108/157.14 |
| 5,934,204 | A * | 8/1999 | Oberle | 108/157.1 |
| 6,237,881 | B1 * | 5/2001 | Levesque | 108/157.1 |
| 7,415,933 | B2 * | 8/2008 | Sagol | 108/157.1 |
| 2008/0245281 | A1 * | 10/2008 | Willy | 108/157.16 |

* cited by examiner

*Primary Examiner* — Jose V Chen
(74) *Attorney, Agent, or Firm* — Douglas Tuman

(57) ABSTRACT

A two-tiered, interlocking, knockdown, sturdy furniture article such as a table, stool or stand which is fabricated and assembled easily from sheet-like material. Two (2) table tops are fabricated by being cut from two (2) base members. The lower table top rests horizontally and is vertically supported by a supporting means within inside walls of the interlocked base members. The upper table top is vertically supported by upper table top receiving ends of the assembled base members. The disassembled primary components can be arranged in a compact orientation for storage or transportation. The disassembled lower table top fits flush within the base member it was cut from and the other base member and upper table top can be similarly flatly arranged and stacked on top.

9 Claims, 6 Drawing Sheets

TWO-TIERED, INTERLOCKING, KNOCKDOWN FURNITURE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Invention

This invention relates to an article of furniture. More particularly, it relates to a portable knockdown furniture item comprising interlocking sheet-like elements which are easily fabricated, easily assembled without special tools to form a stable and strong structure, and which are readily transportable.

2. Description of the Prior Art

The prior art is replete with attempts throughout the centuries to provide a useful, reliable, and simple article of knockdown furniture such as a table, stool or stand which is easily fabricated, easily assembled and disassembled, and yet provides an attractive sturdy and strong structure suitable for its intended use. As exemplified in relevant prior art the challenge in meeting these design goals is to effectively balance them all. For example, simplicity in fabrication and assembly has often been sacrificed to achieve sufficient stability and strength.

General disadvantages with the current knockdown furniture includes furniture that is not stable, furniture that has a weak load capacity, furniture that is too difficult for a laymen to assemble, furniture that requires intricate and expensive fabrication, furniture that has too many pieces to assemble, furniture that requires too much time and too many steps to assemble, furniture that takes up too much storage or shipping space when disassembled, furniture that is too heavy, furniture that requires special tools or fastening means for assembly, furniture that does not provide sufficient table-surface capacity, and furniture that is unattractive.

Additional design criteria commonly considered is cost of fabrication and efficient use of material. Accordingly, attempts have been made to fabricate the components of a table from a single sheet of material while minimizing the amount scrap material produced. Where such attempts have been made, improvements can be made. For example, U.S. Pat. Nos. 2,235,290 and 3,705,556 each contemplate a table with one (1) table top cut from the table's own base members in order to produce a minimum amount of waste or scrap by utilizing the peripheral cuttings from the furniture's top member to construct the support members for the furniture article. Neither patent, however, contemplates or allows for an improved material-saving design, such as one with greater table-surface capacity efficiency, wherein multiple table tops are cut from the table's base members and tiered, providing as much table-surface capacity as a single-tiered table yet within a more confined horizontal space.

Thus despite all the knockdown furniture existing in prior art and particularly the material-saving table designs, an easily fabricated and assembled arrangement that consists of primarily flat pieces, and which can be hand-assembled in a few steps into a strong and sturdy multi-tiered furniture article with improved table-surface capacity efficiency would be highly desirable.

SUMMARY

Accordingly the present invention aims to provide a two-tiered, interlocking, knockdown, sturdy and strong furniture article such as a table, stool or stand which is fabricated and assembled easily from sheet-like material, comprising two (2) table tops and two (2) base members, whereby the table tops are cut from the base members and the table tops are tiered, yielding a material-saving furniture design with improved table surface capacity efficiency.

For purposes of illustration this invention is described in terms of a two-tiered table. It can equally be described in terms of a stool, stand, shelf, or any other article comprising horizontal platforms supported above the floor or ground. In accordance with one embodiment the article of knockdown furniture comprises a pair of rigid, planar, slotted base members interlocked with one another, an upper and lower table top cut from the base members, wherein the lower table top rests horizontally and is vertically supported within inside walls of the base members, and the upper table top rests horizontally and is vertically supported by upper table top receiving ends of the assembled base members. When disassembled the primary components can be arranged in a compact orientation with the lower table top fitting flush within the base member it was cut from and with the other base member and upper table top similarly flatly arranged and stacked on top.

One object of this invention is to provide a knockdown furniture design comprising sheet-like planar parts which can be easily fabricated in multiples from a single sheet or board material and easily assembled or disassembled in a few steps without special tools or fasteners.

Another object is to provide a stable and durable two-tiered knockdown structure which is elegant in function and form.

Another object is to provide a two-tiered knockdown structure which provides twice the table top surface area of a singe tiered table occupying the same horizontal space.

Another object is to provide a knockdown furniture item such as a table wherein its two (2) table tops are cut from its two (2) base members.

Another object is to provide a knockdown furniture item comprising very few parts, such as in an embodiment with two (2) base members, two (2) table tops, and four (4) dowels.

Another object is to provide a knockdown furniture item comprising generally planar parts that are made of sheet or board material including but not limited to plywood, medium density fiberboard (MDF) materials, marble, corrugated material, cardboard, plastic, or the like.

Another object is to provide a knockdown furniture item that comprises planar disassembled parts that can be arranged in a compact manner, such as where the table tops are placed flat within the base members they were cut from and then stacked, to occupy minimal storage and transportation space.

Another object is to provide a knockdown furniture item that can be user-assembled by relatively unskilled personal without tools and in very few steps, such as in an embodiment with four (4) basic steps.

Another object is to provide a knockdown furniture item which is lightweight yet sturdy and strong so that it can support relatively large weight.

Another object is to provide a knockdown furniture item such as a table, stool, or stand whose components can be sold in kit form for ready assembly by the purchaser.

These and other objects, features and advantages of the invention will become more apparent from the following description of the invention and from the claims.

DRAWINGS

Figures

In the following drawings, which form a part of the specification and which are to be construed in conjunction therewith, and in which like reference numerals have been employed throughout wherever possible to indicate like parts in the various views.

Figure 1:
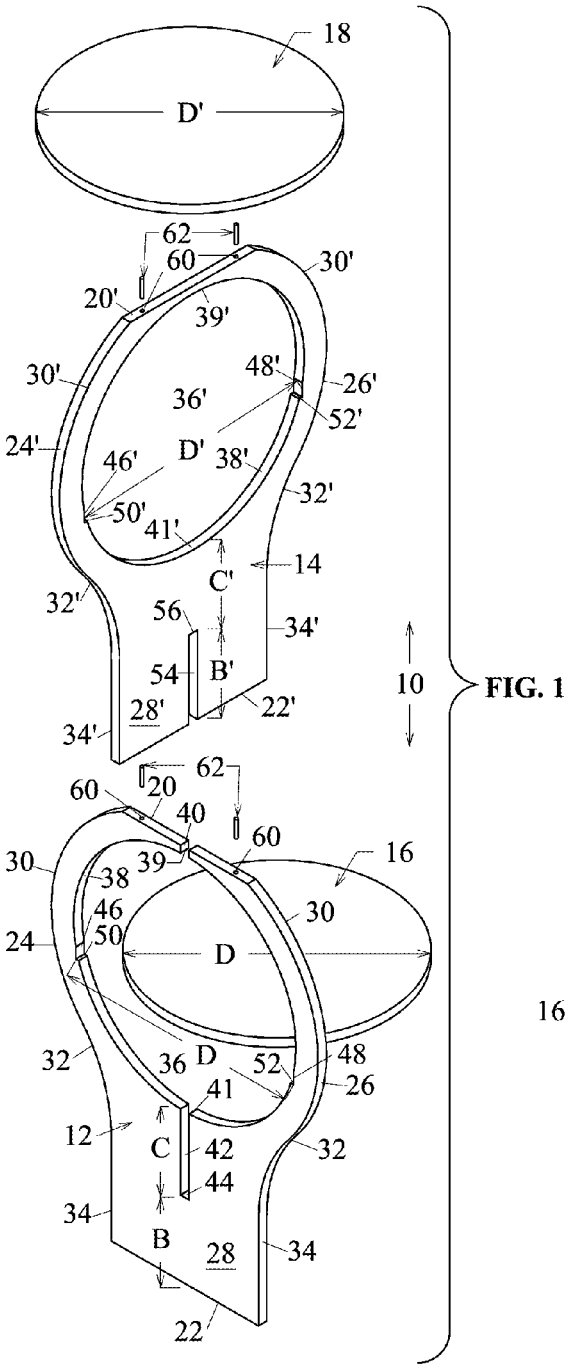
FIG. 1 is an exploded perspective view of a table made in accordance with one embodiment of this invention prior to assembly.

| Reference Numerals | | | |
|---|---|---|---|
| 10 | table | 12, 12b | first base member |
| 14, 14b | second base member | 16, 16b | lower table top |
| 18, 18b | upper table top | 20, 20' | upper table top receiving surface end |
| 22, 22' | floor-engaging end | 24, 24' | side surface |
| 26, 26' | side surface | 28, 28' | front surface |
| 30, 30' | upper edges | 32, 32' | fillet |
| 34, 34' | lower vertical edges | 36, 36', 36b, 36b' | cutout |
| 38, 38', 38b, 38b' | inside-walls | 39, 39' | inside-walls top end |
| 40 | upper slot | 41, 41' | inside-walls bottom end |
| 42 | lower slot | 44 | slot base |
| 46, 46' | vertical side-wall | 48, 48' | vertical side-wall |
| 50, 50' | ledge | 52, 52' | ledge |
| 54 | slot | 56 | slot base |
| 58 | upper table top holes | 60 | table top receiving surface holes |

-continued

| Reference Numerals | | | |
|---|---|---|---|
| 62, 62b | dowels | 64 | sheet of stock material |
| 66 | square table | | |

DETAILED DESCRIPTION

First Embodiment—FIGS. 1-6

Referring initially to drawings FIGS. 1-4, reference numeral 10 illustrates a table constructed in accordance with the invention. At present this embodiment is preferred but other embodiments are also satisfactory. In this first embodiment the table is comprised of four (4) basic parts. A first planar base member 12, a second planar base member 14 which is interlocked with base member 12, a lower planar table top 16 and an upper planar table top 18. When assembled the approximate shape created by the base members is a three-dimensional bulb with lower table top 16 supported vertically and laterally within a spherical void of the bulb and upper table top 18 supported vertically by and secured to a flat top end of the bulb.

Base member 12 is terminated at its upper end by an upper table top receiving surface end 20 and at its lower end by a floor-engaging end 22. The floor-engaging end is a flat horizontal surface which makes continuous contact with the floor. The upper table top receiving surface end is a flat horizontal surface which connects to side surfaces 24 and 26 of the base member which extend downward from opposite sides of the table top receiving surface end to their respective sides of the floor-engaging end. A front surface 28 of the base member has an approximate two-dimensional bulb shape with a chamfered top. The front surface's bulb shape is defined by upper edges 30 which are mirrored convex contours which fillet at points 32 into vertical lower edges 34. A circular cutout 36 of a diameter D is located within the circular portion of the front surface's bulb shape, forming inside-walls 38. Base member 12 is formed with an upper slot 40 through the upper end of the base member, extending from upper table top receiving surface end 20 to a top end 39 of inside-walls 38. A lower slot 42 is aligned with upper slot 40 and extends a distance C from a bottom end 41 of the inside-walls to a slot base 44. Between floor-engaging end 22 and slot base 44 a distance B is defined. A pair of vertical side-walls 46 and 48 and a corresponding pair of ledges 50 and 52 are cut into inside-walls 38 at opposite points along the inside-wall. The top ends of vertical side-walls 46 and 48 are located in the same horizontal plane at a height along inside-wall 38 where the distance between vertical side-walls 46 and 48 is equal to diameter D of cutout 36. Ledges 50 and 52 are horizontal surfaces which share the same horizontal plane and which are normal to vertical side-walls 46 and 48. The taller the vertical side-walls are made, the further the ledges extend and thus the greater the support surface that is created for lower table top 16. Preferably, the vertical side-walls are approximately 4.4 centimeters tall to create ledges that extend approximately 1.6 centimeters.

Base member 14 is substantially identical to base member 12. The corresponding parts of base member 14 are indicated on FIGS. 1 and 2 with the same numerals as those pertaining to base 12 with the addition of prime marks. The one major distinction between base member 12 and base member 14 is that base member 14 does not have slots corresponding to slots 42 and 40. However, base member 14 is provided with a slot 54 extending upwardly from a floor-engaging end 22' to a slot base 56 a distance B'. Between a inside-wall bottom end 41' and slot base 56 of base member 14 a distance C' is defined. Distance B' is approximately equal to distance B and distance C' is approximately equal to distance C. Preferably, distance B' is slightly larger than B by 0.3 centimeters and distance C' is slightly smaller than distance C by 0.3 centimeters to ensure that both floor engaging ends 22 and 22' are in the same plane and make continuous contact with the floor.

Figure 2:
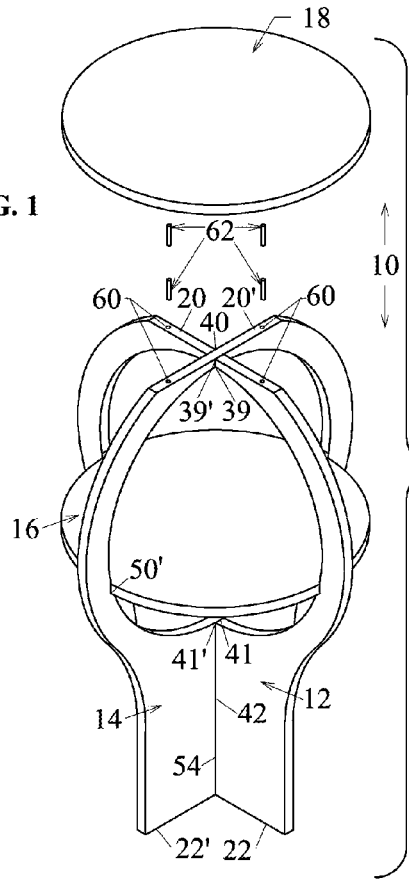
FIG. 2 is an exploded perspective view of the table partially assembled.

As shown in FIG. 2, planar base members 12 and 14 are interlocked by inter-fitting slots 42 and 54 such that floor-engaging ends 22 and 22' fall in a common horizontal plane and upper ends 20 and 20' fall in a common horizontal plane. Also, when interlocked, top ends 39 and 39' of the inside walls fall in a common horizontal plane, as do bottom ends 41 and 41' of the inside walls. Also all of ledges 50-50' and 52-52' which vertically support lower table top 16 fall in a common horizontal plane. When assembled, bases 12 and 14 are normal to one another and are semi-rigid due to the engagement of slot 54 with a lower portion of base 12 defined by distance B, the engagement of slot 42 with a portion of base 14 defined by distance C', and the engagement of slot 40 with the upper end of base 14. All the slot widths approximate the widths of members 12 and 14 to insure a close fit. It is also contemplated that the slot widths can be made slightly wider than the widths of the base members to allow for a thickness added to the base members when coated with paint.

Lower and upper planar table tops 16 and 18 each comprises the byproduct material from either circular cutout 36 or 36' made to the base members. The dimensions of the table tops are substantially identical, having surface diameter's D and D' which correspond approximately to the diameters of the circular cutouts and widths equivalent to the widths of the base members they are cut from. When lower table top 16 is placed horizontally within the spherical void of the bulb formed by the interlocked base member it rests on and is vertically supported by all four (4) ledges 50-50' and 52-52' and fits tightly between all four (4) vertical side walls 46-46' and 48-48' for lateral support.

Figure 3:
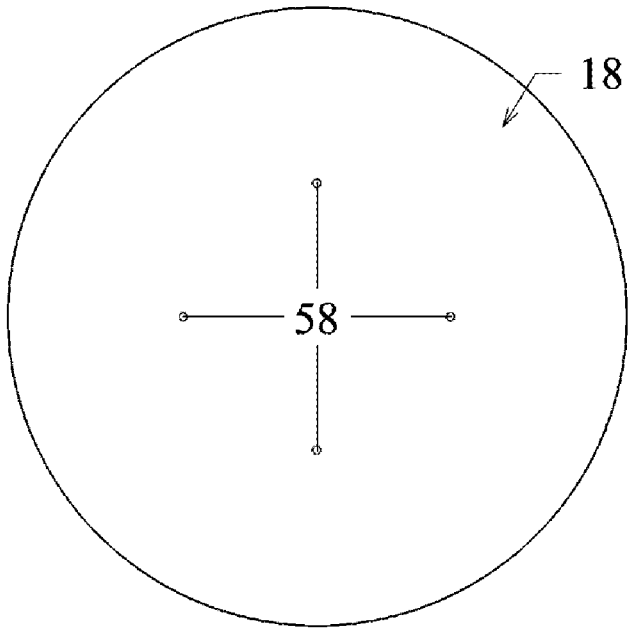
FIG. 3 is a bottom plan view of an upper table top of the table.
Figure 4:
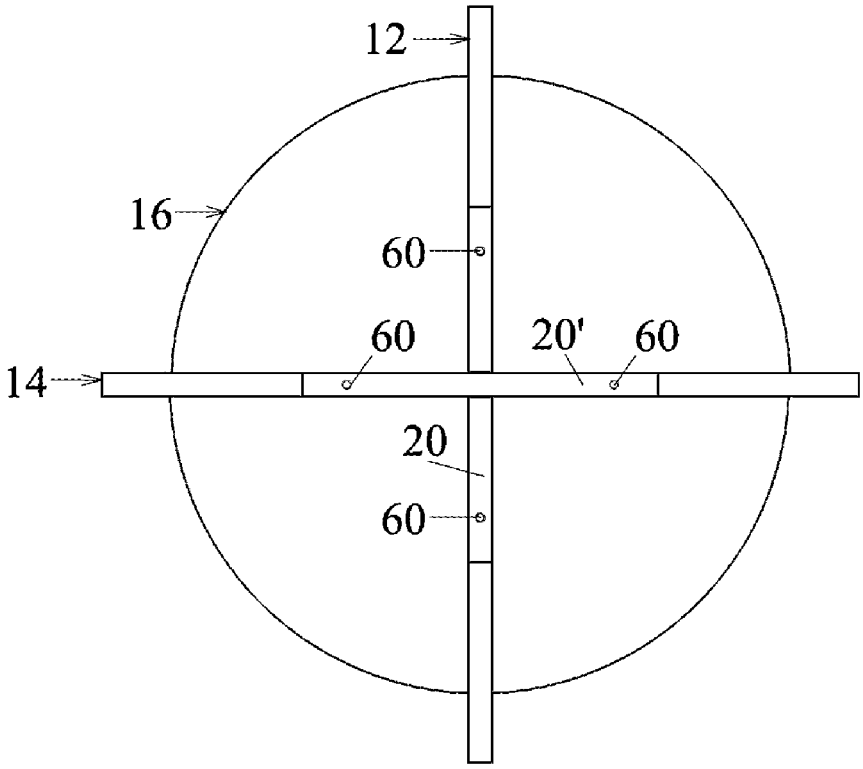
FIG. 4 is a top plan view of the table with the upper table top removed and a lower table top in place.
Figure 5:
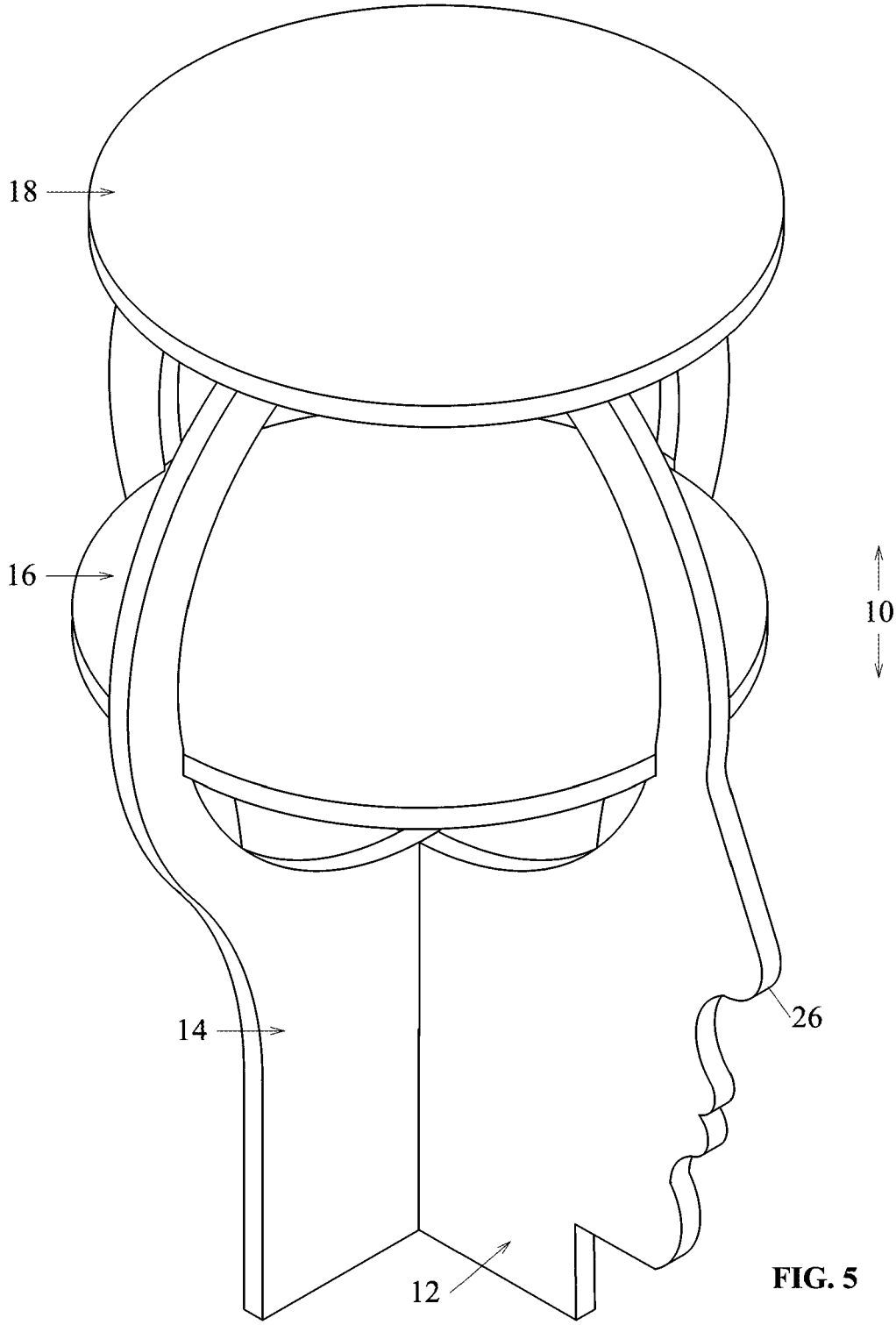
FIG. 5 is a perspective view of the table completely assembled wherein a side surface of a base member resembles a human-face silhouette.

As shown in FIG. 3, the one major distinction between lower table top 16 and upper table top 18 is that the upper table top has four (4) dowel holes 58 on one planar side. As shown in FIG. 4, upper table top receiving surfaces 20 and 20' have four (4) corresponding dowel holes 60, which like holes 58, are adapted to receive approximately half the length of each of dowel 62. Dowels 62 are each of an approximate length necessary to have one half of their length fill a hole of the assembled base, and to have the other half of their length fill the corresponding hole in the upper table top. Holes 58 of the upper table top are aligned with corresponding holes 60 so that when the upper table top is pressed into position dowels 62 that were previously inserted into the assembled base member become inserted into both the assembled base's holes 60 and the table top's holes 58, securing the table top to the base and centering the table top along a vertical axis where the base members 12 and 14 intersect.

The presently contemplated preferred embodiment, table 10 is manufactured from medium density fiberboard material, comprises four (4) basic parts which are designed and shaped as depicted in FIGS. 1-4 and as described above, is of a size that would be suitable for a display stand or end table, utilizes ledges and vertical side-walls for vertical and lateral support of the lower table top, and utilizes dowels for an upper table top fastening means. However variations are possible in shape and design of parts, size of parts, number of parts, means of attachment, materials, and can be made without departing from the scope and spirit of this invention. In other words, various ramifications are possible and within the scope of the claims.

Various sheet materials other than MDF can be used to fabricate the basic parts, such as plywood, marble, sheet metal, plastic, cardboard, or any other sturdy material.

Figure 13:
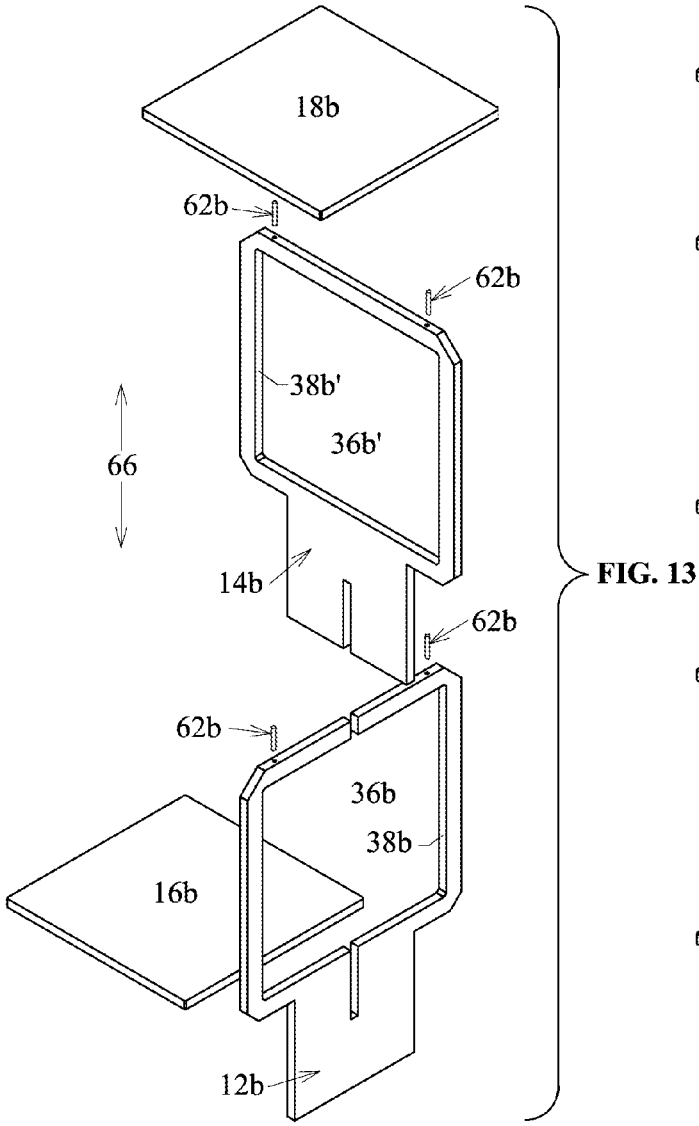
FIG. 13 is an exploded perspective view of a table made in accordance with a second embodiment of the invention.

The four (4) basic parts can all vary greatly in shape and design from the described first embodiment without departing form its scope and spirit, as long as base members 12 and 14 are shaped, cut and slotted in such a way that when the bases are interlocked a void is created by their cutouts 36 and 36' wherein lower table top 16 which is the by-product of cutout 36 or 36' can fit within the void and be vertically and laterally supported by a vertical and lateral support means, such as ledges and vertical side-walls cut into the base member's inside walls 38 and 38', and as long as upper table top 18 that is the by-product of cutout 36 or 36' can be vertically supported by the upper ends of the base members. For example, table tops 16 and 18, cut from base members 12 and 14 may be circular as in the first embodiment or they may assume any other shape where the table tops and the base members they were cut from allows for the construction of a two-tiered interlocking furniture article within the scope of this invention. One example of an alternative design is seen in FIG. 13 and is described below as an alternative or second embodiment. Base members 12 and 14 may be bulb shaped with chamfered top ends as in the first embodiment or they may assume various other shapes such as rectangular, hexagonal, circular with chamfered top ends, or any other shape as long as the interlocked base members can support the two (2) table tops in a manner that is within the scope of this invention. The design of side surfaces 24-24' and 26-26' of the base members can vary as well, such as in FIG. 5 where side surface 26 of base member 12 has a decorative face carved into it.

The number of parts utilized to construct an article of furniture within the scope of this invention can also vary, as long as the article is comprised of at least the four (4) main components: two (2) base members such as base members 12 and 14 and two (2) table tops such as table tops 16 and 18 cut from the base members.

The sizes of articles constructed in accordance with the invention can vary greatly. The first embodiment is sized to be an end table with dimensions of approximately 73.7 centimeters in height and a 167.6-centimeter outside maximum circumference. However, articles of relative small size are possible such as pizza stands, or medium sized articles such as television stands and coffee tables, or larger sized articles such as desks and dinning room tables.

The means of attachment used to connect the table tops to the assembled base can vary as well. In the first embodiment it is contemplated that dowels 62 are used as a fastening means to secure upper table top 18 to the base members and that ledges 50-51' and 52-52' and four (4) vertical side walls 46-46' and 48-48' are used to vertically and laterally support lower table top 16 with no actual physical fastening means other than the lower table top's own weight upon the ledges. However, any technique known in the art can be used to mount lower or upper table top 16 or 18 to the base members including, e.g., adhesives, nails, screws, Velcro, wedges, dove tails, pegs, clips, inherent table top weight, and the like.

Figure 6:
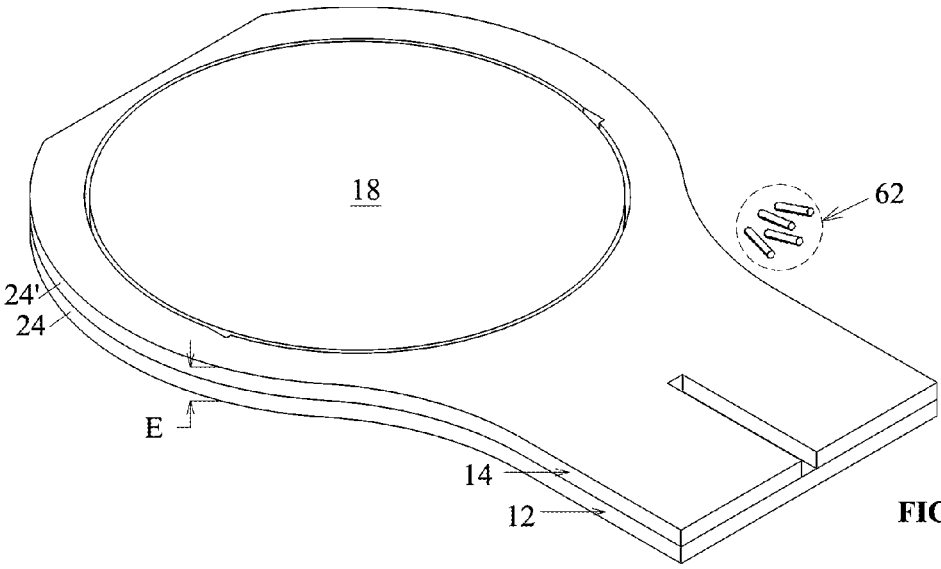
FIG. 6 is a perspective view of unassembled parts of the table arranged in a compact orientation for storage or transportation.

Referring now to FIG. 6, an article of furniture designed in accordance with this invention such as table 10, can be arranged in compact form when disassembled. Each of the four principal elements, namely, base members 12 and 14 and table tops 16 and 18 are planar and can fit into a relatively flat box of small dimensions. Since each table top can lie flush within a base member, a box of only two member widths, equal to a dimension E of FIG. 6, is needed to package the tables pieces. In compact form base member 12 lies flat on its front or back surface and table top 16 lies flat in the same horizontal plane within circular cutout 36 of base member 12. Base member 14 lies flat on top of base member 12 in an orientation where corresponding side surfaces 24-24' and 26-26' lie in the same vertical planes. Table top 18 lies flat on top of table top 16 within circular cutout 36' of base member 14. When the pieces of the table are in storage or transportation form as described, dowels 62 are kept inserted in the base member holes 60 or are packed together in a small bag or are packaged in any other like manner. It is contemplated that a zippered sleeve is a possible option for transporting all the disassembled table pieces.

Operation

First Embodiment

FIGS. 7-12

Figure 7:
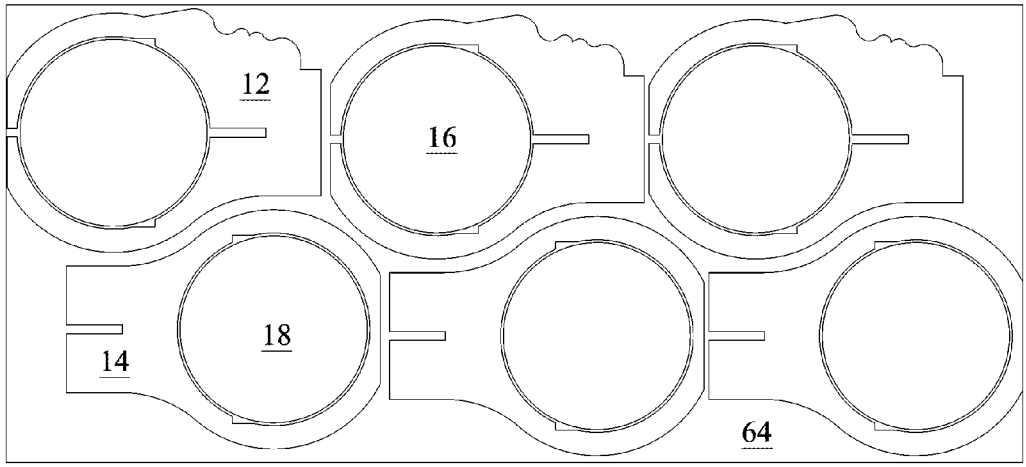
FIG. 7 is a top plan view of a piece of sheet-like material or board having inscribed thereon multiple outlines of the component parts of the table.

The method of fabricating tables of the first embodiment is most easily described with reference to FIG. 7 of the drawings. A flat sheet of stock MDF material of a standard size such as 5'×8' or 4'×8' is designated by reference numeral 64. Inscribed into the sheet are the outlines of three (3) pairs of base members 12 and 14, and inscribed within the base member outlines are the outlines of three (3) pairs of upper and lower table tops 18 and 16. The base members and table tops are cut with a device such as a computer numerical control (CNC) router from the sheet. Then, as depicted in FIGS. 3 and 4 four (4) dowel holes 58 are drilled in one side of upper table top 18 and four (4) dowel holes 60 are drilled into upper table top receiving surfaces 20 and 20'. Once cut from the sheet the parts are ready for assembly, or if desired, as preferred, the parts are painted before assembly. However, the parts can be painted after assembly or not painted at all. In the first embodiment all the primary parts of the table are fabricated from MDF sheet stock. MDF is preferred because it is inexpensive, light yet stiff and strong, durable, easily cut or drilled without surface damage, can be dowelled together, and has absorbent painting surfaces. However, as described earlier, these planar parts could also be suitably fabricated from a wide variety of other stiff sheet-like materials.

Figure 8:
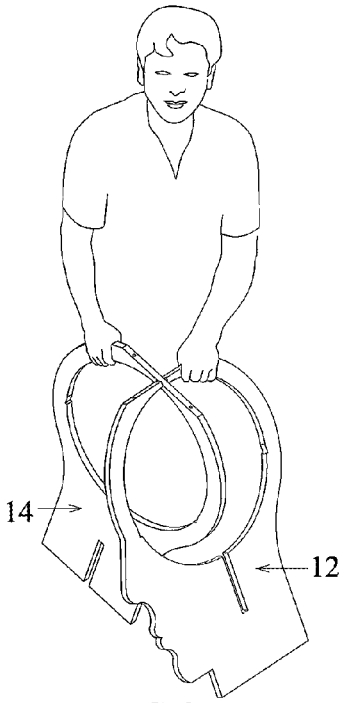
FIG. 8 is a perspective view of a first part of a first step in assembling the table.
Figure 9:
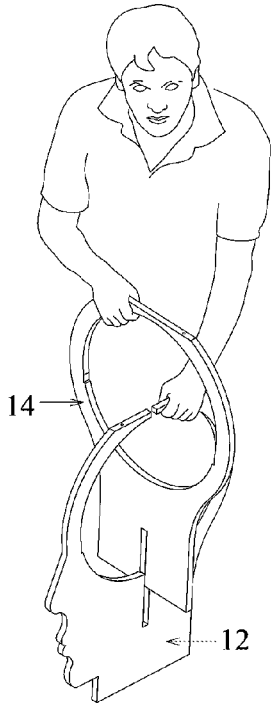
FIG. 9 is a perspective view of a second part of a first step in assembling the table.
Figure 10:
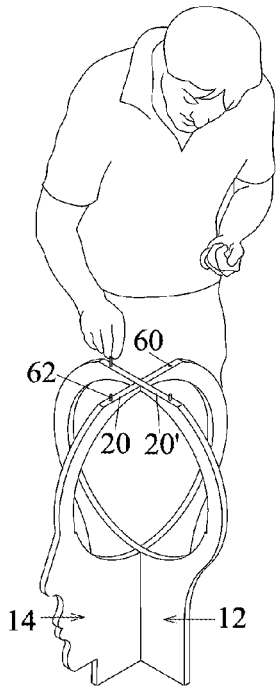
FIG. 10 is a perspective view of a second step in assembling the table.
Figure 11:
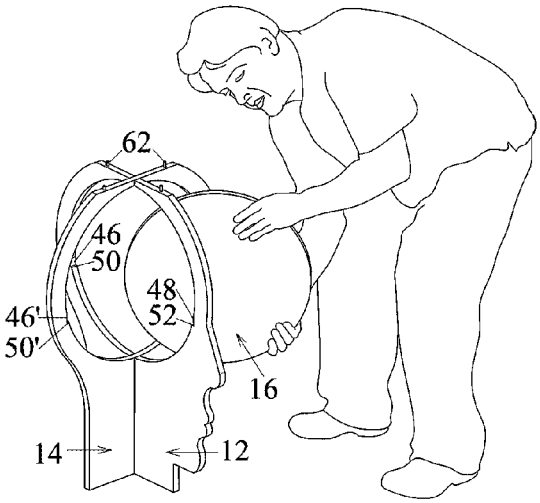
FIG. 11 is a perspective view of a third step in assembling the table.
Figure 12:
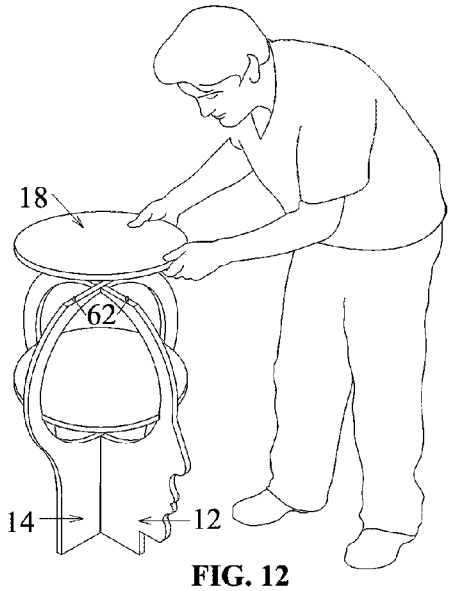
FIG. 12 is a perspective view of a fourth step in assembling the table.

As illustrated in FIGS. 8-12, the first embodiment can be user-assembled by a relatively unskilled person without tools in as few as four (4) basic steps. In a first step, as depicted in FIGS. 8 and 9, base member 12 is interlocked with base member 14 in a very short time and simple manner. In a second step, as depicted in FIG. 10, four (4) dowels 62 are inserted by hand into four (4) holes 60 of upper table top receiving surfaces 20 and 20'. A small hammer or the butt of a screw driver, for example, can be used to tap the dowels in if they do not push in easily enough by hand. In a third step, as depicted in FIG. 11, lower table top 16 is tilted vertically and moved within the spherical void formed by the assembled base members. Once inside the sphere it is turned until it is in a horizontal position between vertical side-walls 46-46' and 48-48' and then it is rested on ledges 50-50' and 52-52'. In the fourth step, as depicted in FIG. 12, upper table top 18 is positioned so that its four (4) holes 58 on the underside of table top 18 are aligned with dowels 62 that have already been inserted into the assembled base. Once aligned, table top 18 is pressed down by hand until each of the four (4) exposed dowel halves are inserted into the table top's holes. If too difficult by hand, a small hammer or the like can be used to tap the table top until its underside is flat against upper table top-receiving surfaces 20-20' and dowels 62 are fully inserted half into holes 60 and half into holes 58. The table is just as quickly and easily disassembled. Once disassembled the table parts can be arranged in compact form as depicted in FIG. 6 and as described above for stowage or transportation. It is contemplated that various methods of fabrication, assembly, and use of the first embodiment are possible and within the scope and spirit of the invention.

Alternative Embodiment

FIG. 13

A second embodiment as depicted in FIG. 13 of the drawings is a square table 66. Table 66 is similar to the first embodiment, table 10, in that both tables are comprised of four (4) basic parts. A first planar base member 12*b*, a second planar base member 14*b* which is interlocked with base member 12*b*, a lower planar table top 16*b*, and an upper planar table top 18*b*. The significant differences between table 10 and 66 are the shapes of the four (4) basic parts, and as a result of their shape, the means of vertically and laterally supporting the lower table top is slightly altered from the first embodiment to effectively secure the lower table top.

The base members of table 66 are square shaped, as opposed to the bulb shaped base members of table 10, and cut-outs 36*b*-36*b*' and their corresponding table tops 16*b* and 18*b* are also square shaped, as opposed to the round table tops of table 10. Upper table top 18*b* is secured to the assembled base with dowels 62*b* in the same manner as upper table top 18 is secured to table 10. The arrangement of table 66 allows lower table top 16*b* to rest horizontally within the interlocked base members and to be supported vertically and laterally by the inside walls 38*b* and 38*b*'. Thus, lower table top 16*b* is supported vertically and laterally only by its relation to the inside walls of the two interlocked base members, as opposed to table 10, which requires an alternative means of vertical and lateral support such as ledges and vertical side-walls cut into the base members circular inside-walls.

Operation

Alternative Embodiment

Fabrication, assembly, and use similarly occur as previously described in the operation of the preferred embodiment.

Additional Embodiments

FIG. 14

Figure 14:
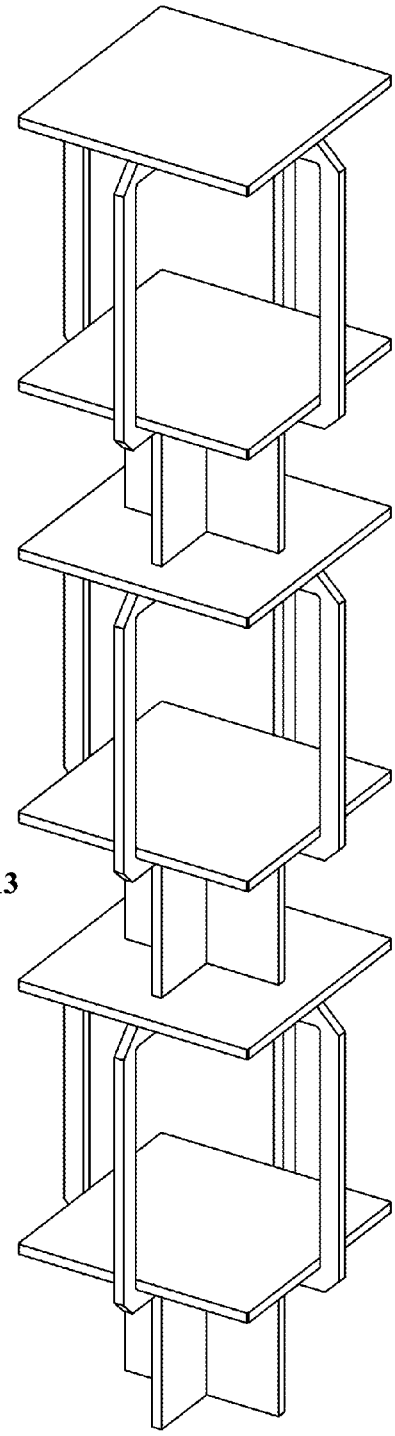
FIG. 14 is a perspective view of a shelf unit made in accordance with a third embodiment of the invention.

Additional embodiments are contemplated such as a third embodiment depicted in FIG. 14 of the drawings. As depicted in FIG. 14, it is contemplated that furniture articles within the scope of this invention, such as the tables described as the first and second embodiments, can be stacked upon each other and secured to each other with a fastening means such as dowels, to effectively create a multi-tiered, interlocking, knockdown furniture item such as a shelf unit.

CONCLUSION, RAMIFICATIONS, AND SCOPE

From the foregoing, it will be seen that this invention is one well adapted to obtain all the ends and objects herein set forth, together with other advantages which are inherent to the structure.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. An article of knockdown furniture comprising:

a first planar base member having a first floor-engaging end, a first upper table top receiving surface end, a first and a second side surface each respectively extending from said first floor-engaging end to said first upper table top receiving surface end, said first planar base member having a longitudinal length defined as a distance between said first floor engaging end and said first upper table top receiving surface end, a first distance between said side surfaces defining a transverse width of the first planar base member, a first cutout within said first planar base member in which edges of the first cutout constitute first inside-walls, said first planar base member having an upper slot through said first upper table top receiving surface end extending into said first cutout, and a lower slot aligned with said upper slot extending from a first bottom end of said first inside-walls to a first slot base, a second planar base member having a slot extending upwardly from a second floor-engaging end to a second slot base, a second cutout within said second planar base member in which edges of the second cutout constitute second inside-walls, said second planar base member angularly disposed to and interlocking with said first planar base member along said slots, said second floor-engaging end in the plane of said first floor-engaging end, a second upper table top receiving surface end in the plane of said first upper table top receiving surface end, a second bottom end of said second inside-walls in the plane of said first bottom end, a third and a fourth side surface each respectively extending from said second planar base member's second floor-engaging end to said second planar base member's second upper table top receiving surface end, a second distance between said third and fourth side surfaces defining a transverse width of said second planar base member, an upper planar table top member comprising byproduct material from either said first or second planar base member's cutout, said interlocked planar base members' upper table top receiving surface ends vertically supporting said upper table top, a lower planar table top member comprising byproduct material remaining from either said first or second planar base member's cutout, said interlocked planar base members' cutouts being shaped to fit said lower table top in a horizontal position within the confines of said inside-walls of said interlocked planar base members, and a means for vertically supporting said lower table top within said interlocked planar base members' inside-walls.

2. The article of knockdown furniture according to claim 1, further comprising a means for laterally supporting said lower table top.

3. The article of knockdown furniture according to claim 2, wherein said cutouts are shaped in such a way that said vertical and lateral support means comprises the vertical and lateral restraint provided by said inside-walls of said base members in relation to said lower table top resting horizontally within said interlocked base members.

4. The article of knockdown furniture according to claim 2, wherein said vertical and lateral support means comprises:

a first pair of vertical side-walls and a corresponding pair of ledges cut into said first base member's first inside-walls at opposite points along the first inside-walls, a second pair of vertical side-walls and a corresponding pair of ledges cut into said second base member's second inside-walls at opposite points along the second inside-walls, wherein said ledges are all located in the same horizontal plane at a height along said first and second interlocked base members' inside-walls which allows said lower table top to rest horizontally and to be vertically supported by all four said ledges and to be laterally supported by all four said vertical side-walls.

5. The article of knockdown furniture according to claim 4, wherein said cutouts and table tops are circular.

6. The article of knockdown furniture according to claim 5, further comprising a fastening means for securing said upper table top to said upper table top receiving surface ends.

7. The article of knockdown furniture according to claim 6 wherein said fastening means comprises dowels inserted into corresponding holes of said upper table top and said upper table top receiving surface ends.

8. The article of knockdown furniture according to claim 7, wherein said base members dimensions are substantially identical and said base members are bulb shaped.

9. The article of knockdown furniture according to claim 1, further comprising a fastening means for securing the floor-engaging ends of a substantially identical article to said upper table top.

* * * * *